US009885527B2

(12) United States Patent
Gao et al.

(10) Patent No.: US 9,885,527 B2
(45) Date of Patent: Feb. 6, 2018

(54) MANIFOLD ASSEMBLY AND HEAT EXCHANGER HAVING MANIFOLD ASSEMBLY

(71) Applicant: SANHUA (HANGZHOU) MICRO CHANNEL HEAT EXCHANGER CO., LTD., Hangzhou (CN)

(72) Inventors: Qiang Gao, Hangzhou (CN); Jun Wang, Hangzhou (CN)

(73) Assignee: SANHUA (HANGZHOU) MICRO CHANNEL HEAT EXCHANGER CO., LTD., Hangzhou (CN)

( * ) Notice: Subject to any disclaimer, the term of this patent is extended or adjusted under 35 U.S.C. 154(b) by 0 days.

(21) Appl. No.: 14/908,408

(22) PCT Filed: Jan. 16, 2014

(86) PCT No.: PCT/CN2014/070745

§ 371 (c)(1),
(2) Date: Jan. 28, 2016

(87) PCT Pub. No.: WO2015/014107

PCT Pub. Date: Feb. 5, 2015

(65) Prior Publication Data

US 2016/0161197 A1 Jun. 9, 2016

(30) Foreign Application Priority Data

Jul. 30, 2013 (CN) ..... 2013 1 0327178
Sep. 18, 2013 (CN) ..... 2013 1 0430058

(51) Int. Cl.
*F28F 27/00* (2006.01)
*F28F 9/02* (2006.01)
(Continued)

(52) U.S. Cl.
CPC ..... *F28F 9/0273* (2013.01); *F28D 1/02* (2013.01); *F28D 1/05366* (2013.01); *F28F 9/22* (2013.01); *F28F 13/06* (2013.01); *F28F 27/02* (2013.01)

(58) Field of Classification Search
CPC ..... F28F 9/026; F28F 9/027; F28F 9/0273; F28F 9/0275; F28F 13/06; F28F 27/02
(Continued)

(56) References Cited

U.S. PATENT DOCUMENTS 560,090 A * 5/1896 Eichhorn ..... F28F 27/02 165/101
2,261,596 A * 11/1941 Stroobants ..... F24D 19/0002 137/625.47
(Continued)

FOREIGN PATENT DOCUMENTS

CN 1467450 A 1/2004
CN 1598470 A 3/2005
(Continued)

OTHER PUBLICATIONS

International Search Report and Written Opinion of the International Searching Authority dated Apr. 23, 2014 for PCT International Application No. PCT/CN21014/070745.
(Continued)

*Primary Examiner* — Hung Q Nguyen
*Assistant Examiner* — Mark L Greene
(74) *Attorney, Agent, or Firm* — Howard & Howard Attorneys PLLC

(57) ABSTRACT

Disclosed are a header assembly and a heat exchanger. The header assembly includes: a header; a distribution member disposed in the header and having a distribution opening; a regulating member disposed movably at the distribution member and configured to regulate the distribution opening;
(Continued)

and a driving member configured to magnetically drive the regulating member to move so as to regulate the distribution opening. By means of changing the position of the driving member, the header assembly and the heat exchanger are capable of changing the position of the regulating member via magnetic force, thereby regulating the distribution opening. Therefore, requirements under different operating conditions can be satisfied, and the applicability and distributing effect for refrigerant are improved.

20 Claims, 9 Drawing Sheets

(51) Int. Cl.

| | |
|---|---|
| ***F28F 27/02*** | (2006.01) |
| ***F28D 1/053*** | (2006.01) |
| ***F28D 1/02*** | (2006.01) |
| ***F28F 9/22*** | (2006.01) |
| ***F28F 13/06*** | (2006.01) |

(58) Field of Classification Search
USPC ..... 165/96
See application file for complete search history.

(56) References Cited

U.S. PATENT DOCUMENTS

| | | | | |
|---|---|---|---|---|
| 2,545,025 | A * | 3/1951 | Erhardt, Jr. | B24B 7/12 118/203 |
| 5,385,122 | A * | 1/1995 | Stalport | F16L 55/027 122/511 |
| 5,690,169 | A | 11/1997 | Foerster | |
| 5,910,167 | A | 6/1999 | Reinke et al. | |
| 5,968,312 | A * | 10/1999 | Sephton | B01D 1/065 159/18 |
| 6,756,023 | B1 * | 6/2004 | Corr | B01J 8/067 422/198 |
| 7,231,962 | B2 * | 6/2007 | Han | F28D 1/05375 165/103 |
| 7,438,124 | B2 * | 10/2008 | Bhatti | H05K 7/20736 165/122 |
| 7,461,687 | B2 * | 12/2008 | Han | F28D 1/05366 165/100 |
| 7,775,263 | B2 * | 8/2010 | Han | F28D 1/05366 165/144 |
| 7,828,044 | B2 * | 11/2010 | Hagberg | F02B 29/0418 165/103 |
| 8,806,883 | B2 * | 8/2014 | Burk | F25B 17/086 62/324.6 |
| 9,644,905 | B2 * | 5/2017 | Rusich | F28F 27/02 |
| 2004/0007349 | A1 | 1/2004 | Youn et al. | |
| 2005/0056402 | A1 * | 3/2005 | Han | F28D 1/05366 165/103 |
| 2007/0074866 | A1 * | 4/2007 | Bhatti | H05K 7/20736 165/248 |
| 2008/0000629 | A1 | 1/2008 | Viczena | |
| 2011/0017438 | A1 | 1/2011 | Huazhao et al. | |
| 2011/0203780 | A1 | 8/2011 | Jiang et al. | |
| 2013/0240767 | A1 | 9/2013 | Naumann | |
| 2013/0312944 | A1 | 11/2013 | Gao et al. | |
| 2014/0083117 | A1 * | 3/2014 | Rusich | F25B 39/028 62/56 |
| 2014/0137592 | A1 | 5/2014 | Matsumoto et al. | |
| 2015/0362263 | A1 * | 12/2015 | Wang | F28F 9/0273 165/100 |
| 2016/0161197 | A1 | 6/2016 | Gao et al. | |

FOREIGN PATENT DOCUMENTS

| | | | |
|---|---|---|---|
| CN | 1666081 | A | 9/2005 |
| CN | 101691981 | A | 4/2010 |
| CN | 101839590 | A | 9/2010 |
| CN | 101886891 | A | 11/2010 |
| CN | 103486896 | A | 1/2014 |
| CN | 103649667 | A | 3/2014 |
| DE | 19601579 | C2 | 12/1997 |
| EP | 0106544 | A1 | 4/1984 |
| EP | 1515110 | A2 | 3/2005 |
| EP | 2362176 | A2 | 8/2011 |
| JP | S61291898 | A | 12/1986 |
| JP | H01169281 | A | 7/1989 |
| JP | 2000329250 | A | 11/2000 |
| JP | 2002195694 | A | 7/2002 |
| JP | 2005090950 | A | 4/2005 |
| JP | 3976326 | B2 | 9/2007 |
| JP | 2011017505 | A | 1/2011 |
| WO | 2012075772 | A1 | 6/2012 |
| WO | 2012080055 | A2 | 6/2012 |
| WO | 2013008464 | A1 | 1/2013 |

OTHER PUBLICATIONS

Notification of Reasons for Refusal dated Dec. 14, 2016 for Japanese Patent Application No. 2016-528302 (8 pages).
First Notification of Office Action dated Mar. 8, 2017 for Korean Patent Application No. 10-2015-7034131 (17 pages).
Communication dated Mar. 17, 2017 enclosing the Extended European Search Report dated Mar. 8, 2017 for European Patent Application No. 14831990.8 (6 pages).

* cited by examiner

MANIFOLD ASSEMBLY AND HEAT EXCHANGER HAVING MANIFOLD ASSEMBLY

CROSS-REFERENCE TO RELATED APPLICATIONS

The present application is a National Stage of International Patent Application No. PCT/CN2014/070745 filed on Jan. 16, 2014, which claims priority to and all the benefits of Chinese Patent Application No. 201310327178.2 filed on Jul. 30, 2013, and Chinese Patent Application No. 201310430058.5 filed on Sep. 18, 2013, all of which are hereby expressly incorporated herein by reference in their entirety.

BACKGROUND OF THE INVENTION

1. Field of the Invention

The present invention relates to the field of heat exchanging, particularly to a header assembly and a heat exchanger including the header assembly.

2. Description of the Related Art

The heat exchanger, such as a micro-channel heat exchanger, in the related art needs to distribute a refrigerant when used as an evaporator in order to improve the uniformity and effect of heat exchanging. Typically, a distributing tube of a built-in type is inserted into the header from an end of the header. The distributing tube has a plurality of openings through which the refrigerant may flow into the header.

However, the shape and position of the openings of the distributing tube in the related art are fixed. When operating conditions of the heat exchanger is changed, the distribution of the refrigerant cannot be regulated, so that the uniformity and performance of heat exchanging are reduced. Therefore, there is a need to improve the heat exchanger.

SUMMARY OF THE INVENTION

Embodiments of the present disclosure seek to solve at least one of the problems existing in the related art to at least some extent. Therefore an object of the present disclosure is to provide a header assembly which may adjust the distribution of the refrigerant as desired and may improve the distributing effect of the refrigerant.

Another object of the present disclosure is to provide a heat exchanger including the header assembly.

The present invention is directed toward a header assembly including: a header; a distribution member disposed within the header and having at least one distribution opening; a regulating member disposed movably at the distribution member and configured to regulate the distributing opening; and a driving member configured to magnetically drive the regulating member to move so as to regulate the distribution opening.

With the header assembly according to embodiments of the present invention, by changing the position of the driving member, the position of the regulating member may be changed via magnetic force. In this way, the distribution opening may be regulated, thus regulating the distribution of the refrigerant. Therefore the refrigerant distribution may be regulated conveniently according to specific application requirements, which may satisfy different operations conditions. In addition, both the effect of refrigerant distribution and the applicability of the header assembly may be improved.

In some embodiments, the driving member may be disposed externally of the header. In some embodiments, the driving member may be disposed on an outer wall of the header, and a position of the driving member may be adjustable.

In some embodiments, at least one of the regulating member and the driving member may be a permanent magnet. In some embodiments, one of the regulating member and the driving member may be a permanent magnet, and the other may be capable of interacting with the permanent magnet via magnetic force. In some embodiments, the other of the regulating member and the driving member may be a steel part. In some embodiments, the regulating member may be movable along an axis direction of the header, and a position of the driving member may be adjustable along the axial direction of the header.

In some embodiments, a protrusion may be disposed on an outer wall of the header, at least one groove may be formed in the protrusion and configured to receive the driving member, and the position of the driving member may be adjustable along the axial direction of the header.

In some embodiments, one groove may be formed in the protrusion and extended along the axial direction of the header, and the driving member may be slidably disposed in the one groove. In some embodiments, a plurality of grooves may be formed in the protrusion and spaced apart from each other along the axial direction of the header, and the driving member is adapted to be selectively disposed in any of the plurality of grooves.

In some embodiments, the distribution member may include a plurality of distribution openings, the header assembly may include a plurality of regulating members and a plurality of driving members, and the plurality of distribution openings may be in one-to-one correspondence with the plurality of regulating members, and with the plurality of driving members, respectively.

In some embodiments, the distribution member may include a sliding groove formed at a position corresponding to the plurality of the distribution openings, and the regulating member may be fitted in the sliding groove and movable along the axial direction of the header.

In some embodiments, the distribution opening is configured as an elongated groove extended along the axial direction of the header, the header assembly may include a plurality of regulating members and a plurality of driving members in one-to-one correspondence with the plurality of regulating members, and the plurality of regulating members may be spaced apart from each other in the axial direction of the header.

In some embodiments, the distribution member is configured as a distributing tube, the distribution opening is configured as an elongated groove extended along a circumferential direction of the distributing tube, the regulating member may be disposed on a wall of the distributing tube and movable along the circumferential direction of the distributing tube, and the driving member may be disposed on an outer wall of the header and a position of the driving member may be adjustable along a circumferential direction of the header.

In some embodiments, a protrusion is disposed on an outer wall of the header and at least one groove is formed in the protrusion, the driving member may be disposed in the groove and the position of the driving member may be adjustable along the circumferential direction of the header.

In some embodiments, a plurality of grooves may be formed in the protrusion, and the driving member is adapted to be selectively disposed in any of the plurality of grooves.

In some embodiments, one groove is formed in the protrusion and extended along the circumferential direction of the header, and the driving member may be disposed in the groove and slidable along the circumferential direction of the header.

In some embodiments, a plurality of distribution openings may be formed in the distribution member and spaced apart in the axial direction of the distributing tube. A plurality of protrusions may be disposed on the header, spaced apart along the axial direction of the header and in one-to-one correspondence with the plurality of distribution openings. The header assembly may include a plurality of driving members and a plurality of regulating members, and the plurality of driving members may be in one-to-one correspondence with the plurality of regulating members, with the plurality of distribution openings, and with the plurality of protrusions, respectively.

In some embodiments, the distribution member is configured as a distributing tube, the distribution opening is configured as an elongated groove extended along a spiral direction of the distributing tube, the regulating member may be disposed on a wall of the distributing tube and movable along the spiral direction, and the driving member may be disposed on an outer wall of the header and a position of the driving member may be adjustable along the spiral direction.

In some embodiments, the driving member may be disposed within the header, the regulating member may be a permanent magnet or a member capable of interacting with the permanent magnet via magnetic force, and the driving member may include a plurality of electromagnets disposed along an circumferential direction or an axial direction of the header and spaced apart from each other. In some embodiments, the driving member may be disposed on an inner wall of the header.

In some embodiments, the driving member may be disposed externally of the header, the regulating member may be a permanent magnet or a member capable of interacting with the permanent magnet via magnetic force, and the driving member may include a plurality of electromagnets disposed along a circumferential direction or an axial direction of the header and spaced apart from each other. In some embodiments, the driving member may be disposed on an outer wall of the header.

In some embodiments, the header assembly may include a plurality of driving members and a plurality of regulating members in one-to-one correspondence with the plurality of driving members.

In some embodiments, the distribution opening is configured as an elongated groove extended along an axial direction of the distribution member, the header assembly may include a plurality of regulating members and a plurality of driving members in one-to-one correspondence with the plurality of regulating members, and the plurality of regulating members may be spaced apart from each other in the axial direction of the distribution member.

Embodiments of the present disclosure provide a heat exchanger including: a first header assembly and a second header assembly, at least one of the first and second header assemblies being the above-mentioned header assembly according to embodiments of the present disclosure; a tubes each defining a first end connected with a first header of the first header assembly, and a second end connected with a second header of the second header assembly; and fins disposed between adjacent tubes.

Other objects, features and advantages of the present invention will be readily appreciated as the same becomes better understood after reading the subsequent description taken in connection with the accompanying drawings.

BRIEF DESCRIPTION OF THE DRAWINGS

Other advantages of the invention will be readily appreciated as the same becomes better understood by reference to the following detailed description when considered in connection with the accompanying drawings, wherein.

REFERENCE NUMERALS IN THE DRAWINGS

Figure 1:
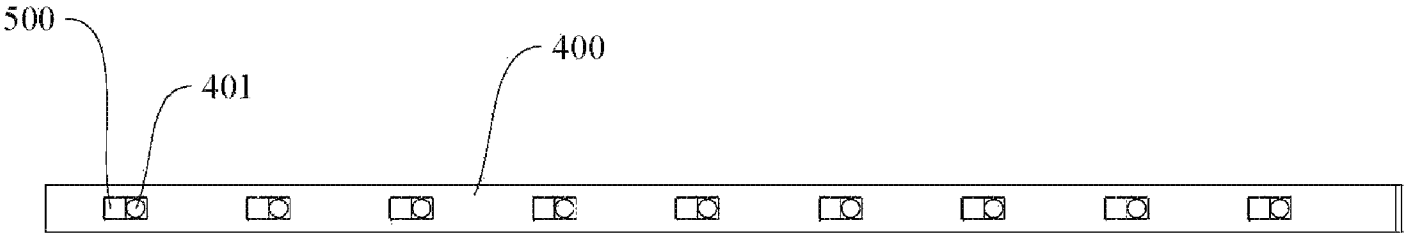
FIG. 1 is a schematic view of a distributing tube of a header assembly according to an embodiment of the present disclosure.

100: header; 100A: first header; 100B: second header; 200: tube; 300: fin; 400: distributing tube; 401: distribution opening; 402: sliding groove; 500: regulating member; 600: driving member; 700: protrusion; 701: groove; 800: controller; 900: power source.

DETAILED DESCRIPTION OF THE INVENTION

Reference will now be made in detail to embodiments of the present disclosure. The embodiments described herein with reference to drawings are explanatory, illustrative, and used to generally understand the present disclosure. The embodiments shall not be construed to limit the present disclosure. The same or similar elements and the elements having same or similar functions are denoted by like reference numerals throughout the descriptions.

The header assembly according to embodiments of the present disclosure will be described below with reference to the drawings. As shown in FIGS. 1-13, the header assembly according to embodiments of the present disclosure may include a header 100, a distribution member, a regulating member 500 and a driving member 600.

The distribution member is disposed within the header 100. The distribution member has at least one distribution opening 401 for distributing refrigerant into the header 100. The regulating member 500 is movably disposed on the distribution member to regulate the distribution opening 401. The driving member 600 is used to drive the regulating member 500 via magnetic force to moves so as to regulate the distribution opening 401.

It shall be appreciated that, the phase "regulate the distribution opening" shall be understood broadly herein in the present disclosure. For example, the phase "regulate the distribution opening" may include adjusting the opening degree of the distribution opening, the position of the distribution opening, the opening direction of the distribution opening or the opening angle of distribution opening. In other words, as far as the movement of the regulating apart results in changing of at least one selected from the group consisting of the amount of refrigerant ejected by the distribution opening, the position where the refrigerant are ejected, the ejecting direction of the refrigerant and the ejecting angle of the refrigerant, it should be appreciated that the distribution opening is regulated.

With the header assembly according to embodiments of the present disclosure, by changing the position of the driving member 600, the position of the regulating member 500 may be changed via magnetic force, and the distribution opening 401 may be regulated. Therefore the distribution of the refrigerant may be adjusted. In this way, the distribution of the refrigerant may be adjusted conveniently as desired, and requirements for different operation conditions may be satisfied, thereby both the applicability and distributing effect of the refrigerant may be improved.

As shown in FIGS. 1-10, in some embodiments, the driving member 600 may be disposed externally of the header 100. Preferably, the driving member 600 may be disposed on an outer wall of the header 100 and the position of the driving member 600 may be adjustable, thus facilitating the assembling and movement of the driving member 600.

It shall be appreciated that, the expression "the position of the driving member 600 may be adjustable" shall be understood broadly herein and includes that the driving member 600 may change its position continuously, and that the driving member 600 may be disposed at different positions. In other words, "the position of the driving member 600 may be adjustable" means that the position of the driving member 600 is changeable.

It shall be appreciated that, the driving member 600 may be disposed at a position other than on the outer wall of the header 100, as far as the distribution opening 401 can be regulated by moving the driving member 600 so as to change the position of the regulating member 500. For example, the driving member 600 may be mounted externally of the header 100 and on a separate support (not shown) which is disposed adjacent to the header 100.

In some embodiments, at least one of the regulating member 500 and the driving member 600 may be configured as a permanent magnet. For example, one of the regulating member 500 and the driving member 600 is a permanent magnet, and the other of the regulating member 500 and the driving member 600 is capable of interacting with the permanent magnet via magnetic force. In an embodiment, the other of the regulating member 500 and the driving member 600 may be configured a steel part. Alternatively, the other of the regulating member 500 and the driving member 600 may be made from other materials. In some embodiments, the regulating member 500 is a permanent magnet, and the driving member 600 is a steel part. Alternatively, the driving member 600 is a permanent magnet, and the regulating member 500 is a steel part. Further alternatively, both the regulating member 500 and the driving member 600 are electromagnets. In an embodiment, the regulating member 500 and the driving member 600 are interacted via magnetic force.

In some embodiments, the distribution member may be configured as a distributing tube 400. The distributing tube 400 may be a circular tube. Alternatively, the cross-section of the distributing tube 400 may have other shapes such as a rectangle and so on.

For the convenience of description, in the following description, the distribution member is embodied as a distributing tube 400 having a circular cross-section, the regulating member 500 is a steel part, and the driving member 600 is a permanent magnet. It shall be appreciated that this is explanary and should not be construed as limitation to the present disclosure.

In some embodiments, the regulating member 500 may be movable in an axis direction of the header 100, and the position of the driving member 600 may be adjustable in the axial direction of the header 100.

Figure 2:
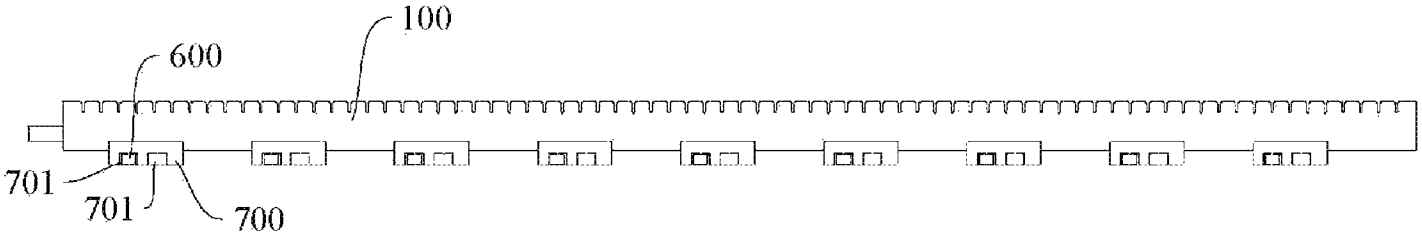
FIG. 2 is a schematic view of a header of a header assembly according to an embodiment of the present disclosure.
Figure 3:
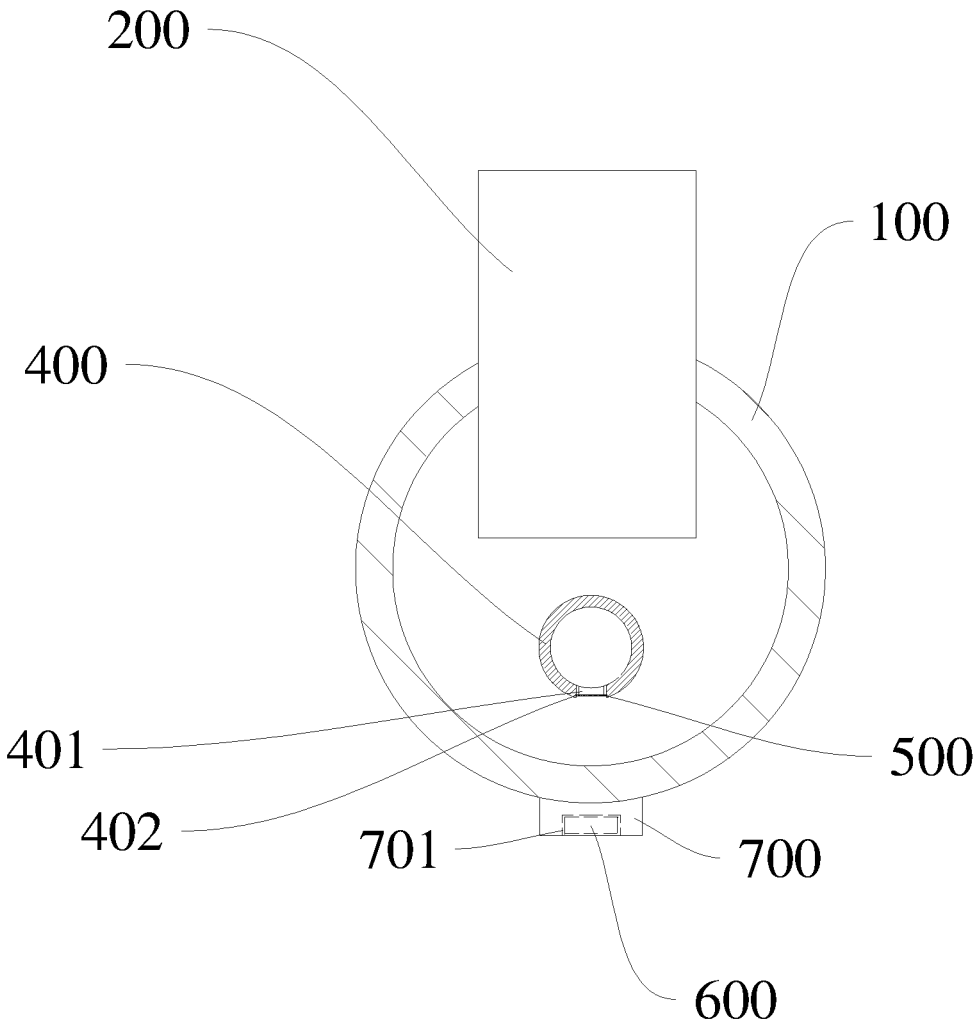
FIG. 3 is a schematic view of a header assembly according to an embodiment of the present disclosure, in which a tube is shown.

As shown in FIGS. 1-3, distributing tube 400 has a plurality of distribution openings 401 spaced apart from each other in an axial direction (left-right direction in FIG. 1, i.e. the axial direction of the header 100) of the distributing tube 400. Specifically, the plurality of distribution openings 401 may be distributed linearly. It is appreciated that, the plurality of distribution openings 401 may be distributed spirally along the axial direction of the distributing tube 400. Alternatively, the plurality of distribution openings 401 may be distributed in any other suitable manners.

Accordingly, one regulating member 500 may be disposed at each distribution opening 401. A sliding groove 402 may be formed in a side wall of the distribution opening 401, and by means of sliding the regulating member 500 along the axial direction of the distributing tube 400, the distribution opening 401 may be regulated. In some embodiments, a plurality of driving members 600 (such as permanent magnet) may be disposed on an outer wall of the header 100. The expression "position of the driving member 600 is adjustable" means the position of the driving member 600 with regard to the header 100 is changeable. For example, the driving member 600 may be slidable with regard to the header 100, or the driving member 600 may be fixed at different positions with regard to the header 100. In some embodiments, the plurality of driving members 600 may be in one-to-one correspondence with the plurality of regulating members 500. When the position of one driving member 600 is changed, the regulating member 500 corresponding to the one driving member 600 may be moved with regard to the distributing tube 400, thus the distribution opening 401 is regulated.

In some embodiments, as shown in FIGS. 1-3, a plurality of protrusions 700 are disposed or formed on an outer wall of the header 100 and in one-to-one correspondence with the plurality of distribution openings 401. The protrusion 700 may include a plurality of grooves 701 formed therein and spaced apart from each other in the axial direction of the header 100. The driving member 600 is adapted to be selectively disposed in any of the plurality of grooves 701. It is appreciated that, the term "selectively dispose" should be understood broadly, i.e. the driving member 600 may be mounted or positioned in any of the plurality of grooves 701. When the driving member 600 is moved from one groove 701 to another groove 701, the position of the driving member 600 is changed, thus driving the regulating member 500 to move and thereby regulating the distribution opening 401.

In some embodiments, the protrusion 700 may be mounted on an outer wall of the header 100 via welding. Alternatively, the protrusion 700 may be fixed to the outer wall of the header 100 via a fixing element such as a clipping element. The driving member 600 may be fixed in the groove 701 via magnetic force. If the protrusion 700 is made from non-metallic material, the driving member 600 may be selectively disposed in the groove 701 in other manners, for example, the driving member 600 may be selectively disposed in the groove 701 via a snap fit.

In some embodiments, one groove 701 may be formed in the protrusion 700 and extended along the axial direction of the header 100. The driving member 600 may be disposed in the groove 701, and slidable in the axial direction of the header 100 so as to change the position thereof.

Figure 4:
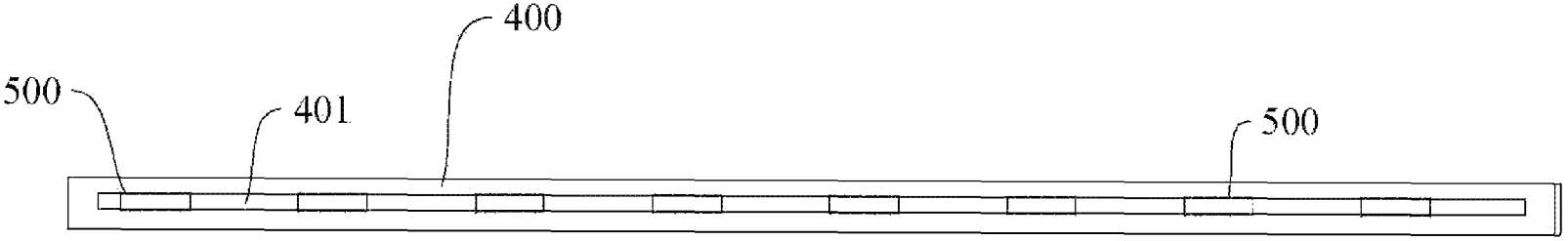
FIG. 4 is a schematic view of a distributing tube of a header assembly according to another embodiment of the present disclosure.
Figure 5:
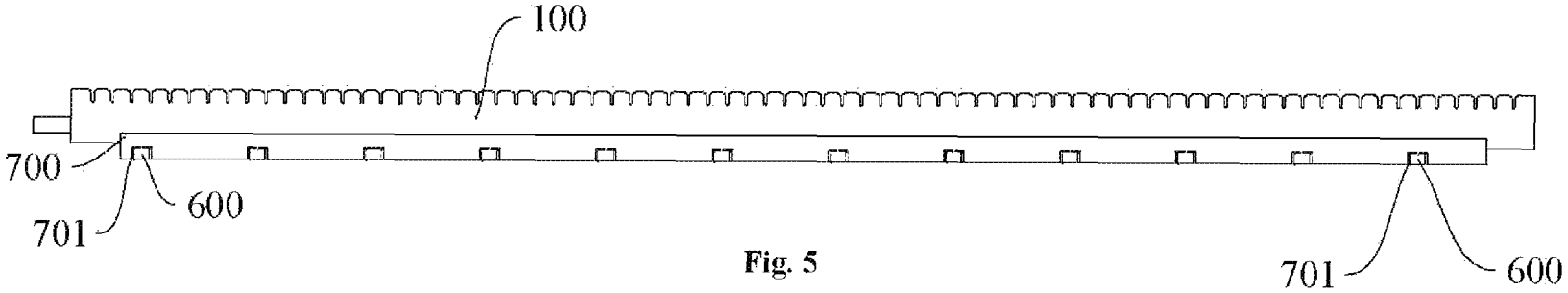
FIG. 5 is a schematic view of a header of a header assembly according to another embodiment of the present disclosure.
Figure 6:
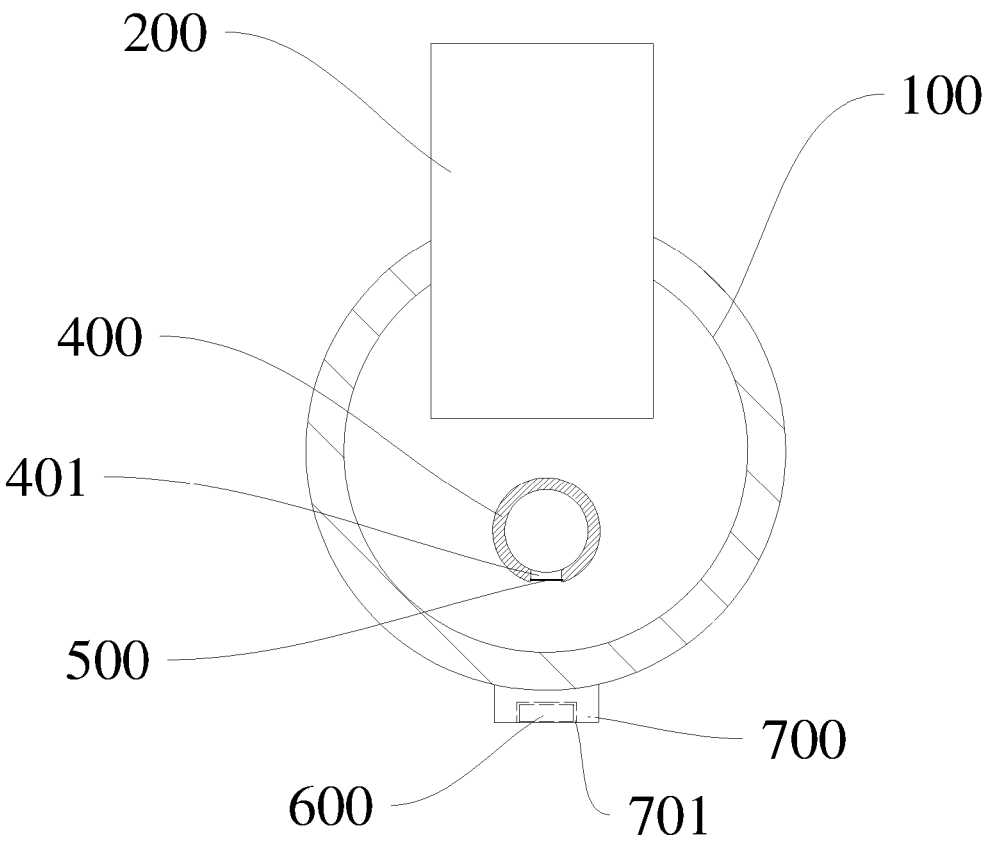
FIG. 6 is a schematic view of a header assembly according to another embodiment of the present disclosure, in which a tube is shown.

In some embodiments, as shown in FIGS. 4-6, the distribution opening 401 is formed as an elongated groove extended along the axial direction of the distributing tube 400. The header assembly may include a plurality of regulating members 500 and a plurality of driving members 600 in one-to-one correspondence with the plurality of regulating members 500. The plurality of regulating members 500 are spaced apart from each other in the axial direction of the distributing tube 400. Alternatively, the elongated groove may be extended spirally about the axial of the distributing tube 400, i.e. along a spiral direction. In such cases, the position of the driving member 600 may be adjustable along the spiral direction. In this way, the regulating member 500 may be driven to move along the spiral direction, thus regulating the distribution opening 401.

In some embodiments, a sliding groove 402 may be formed in a side wall of the elongated groove, and the corresponding side of each regulating member 500 is fitted in the sliding groove 402. As shown in FIGS. 1-3, in some embodiments, a plurality of protrusions 700 are disposed on the outer wall of the header 100, a plurality of grooves 701 may be formed in each protrusion 700, and the driving member 600 is adapted to be selectively disposed in any of the plurality of grooves 701. Alternatively, one protrusion 700 is formed on the outer wall of the header 100 and extended along the axial direction of the header 100. A plurality of grooves 701 spaced apart from each other in the axial direction of the header 100, or one groove 701 extended along the axial direction of the header 100 may be formed in the one protrusion 700.

Other structures and operations shown in embodiments shown in FIGS. 4-6 are substantially the same as those in FIGS. 1-3, thus details related thereof are omitted herein.

Figure 7:
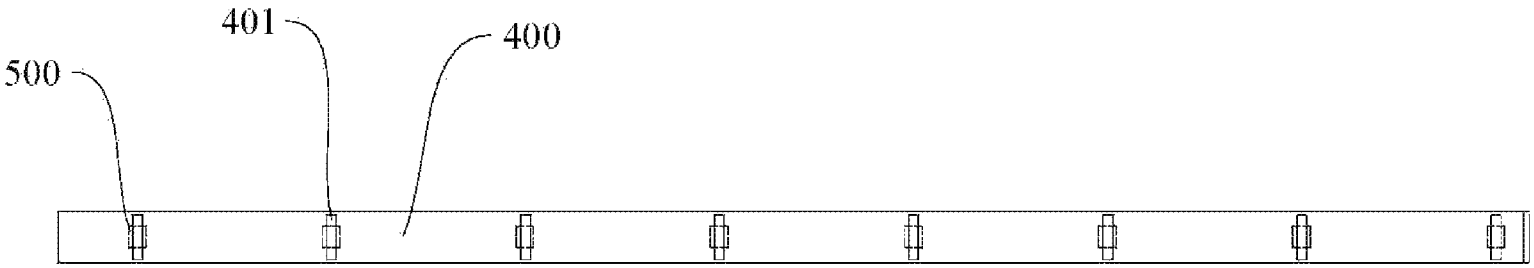
FIG. 7 is a schematic view of a distributing tube of a header assembly according to a further embodiment of the present disclosure.
Figure 8:
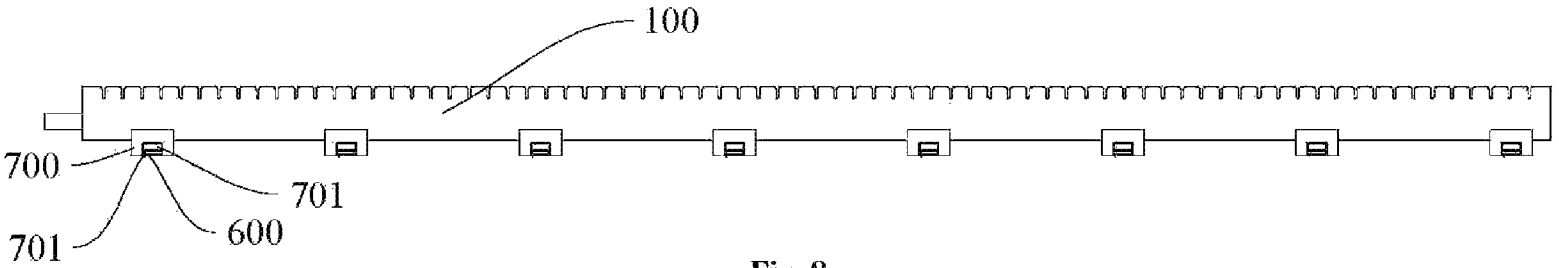
FIG. 8 is a schematic view of a header of a header assembly according to a further embodiment of the present disclosure.
Figure 9:
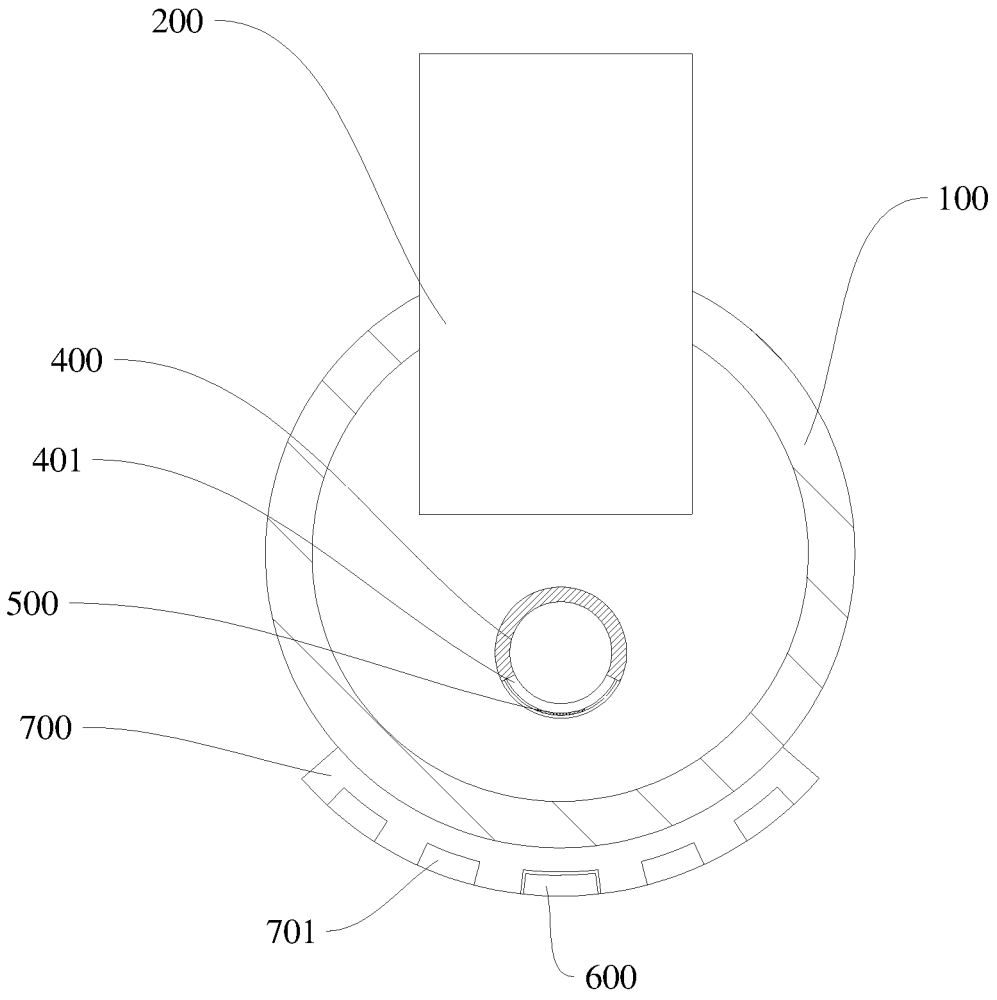
FIG. 9 is a schematic view of a header assembly according to a further embodiment of the present disclosure, in which a tube is shown.

As shown in FIGS. 7-9, in some embodiments, a plurality of distribution openings 401 are provided, each distribution openings 401 is formed as an elongated groove extended along a circumferential direction of the distributing tube 400. The header assembly includes a plurality of regulating members 500 and a plurality of driving members 600, and the plurality of distribution openings 401 are in one-to-one correspondence with the plurality of regulating members 500, and with the plurality of driving members 600, respectively. The regulating member 500 may be slidable in the circumferential direction of the distributing tube 400. For example, a sliding groove 402 may be formed in a side wall of the elongated groove, and the corresponding side of the regulating member 500 is moveably fitted in in the sliding groove 402. The driving member 600 may be disposed on an outer wall of the header 100, and the position of the driving member 600 may be adjustable in the circumferential direction of the header 100.

In some embodiments, a protrusion 700 may be formed on the outer wall of the header. A groove 701 may be formed in the protrusion 700, and the driving member 600 may be disposed in the groove 701 and the position of the driving member 600 may be adjustable in the circumferential direction of the header 100.

Alternatively, a plurality of grooves 701 may be formed in the protrusion 700, and the driving member 600 is adapted to be selectively disposed in any of the plurality of grooves 701. In other words, the driving member 600 may be positioned or mounted in any of the plurality of grooves 701. Further alternatively, one groove 701 extended along the circumferential direction of the header 100 may be formed in the protrusion 700, and the driving member 600 may be disposed in the one groove 701 and slidable in the circumferential direction of the header 100.

In some embodiments, as shown in FIGS. 8-9, there are a plurality of distribution openings 401 spaced apart in the axial direction of the distributing tube 400. A plurality of protrusions 700 spaced apart along the axial direction of the header 100 may be formed on the outer wall of the header 100, and each of the plurality of protrusions 700 may be extended along the circumferential direction of the header 100. A plurality of grooves 701 spaced apart along the circumferential direction of the header 100 may be formed in each of the plurality of protrusions 700. The groove 701 is configured to receive the driving member 600, and the driving member 600 is adapted to be selectively disposed in any of the plurality of grooves 701. Then the position of the driving member 600 may be changed so as to drive the regulating member 500 to move and to regulate the distribution opening 401. Alternatively, one groove 701 may be formed in each of the plurality of protrusions 700, and the driving member 600 is adapted to be selectively disposed in the one groove 701 and is slidable in the one groove 701.

It is appreciated that, the protrusion 700 corresponding to each distribution opening 401 may be extended along the circumferential direction of the header 100 and be integrally formed as a single piece. Alternatively, the protrusion 700 may include a plurality of sub-protrusions spaced apart from each other in the circumferential direction of the header 100.

In some embodiments, the distribution opening 401 configured as the elongated groove may extend spirally about the axis of the distributing tube 400 (i.e. along a spiral direction), and the position of the regulating member 500 is adjustable in the spiral direction. In this way, the regulating member 500 may be driven to move in the spiral direction, thus regulating the distribution opening 401.

By means of disposing the driving member 600 on the outer wall of the header 100, the regulating member 500 positioned in the header 100 may be driven to move the regulating member 500, thus regulating the distribution opening 401. The header assembly according to embodiments of the present disclosure may be applied in different applications and the refrigerant distribution effect is improved.

Figure 11:
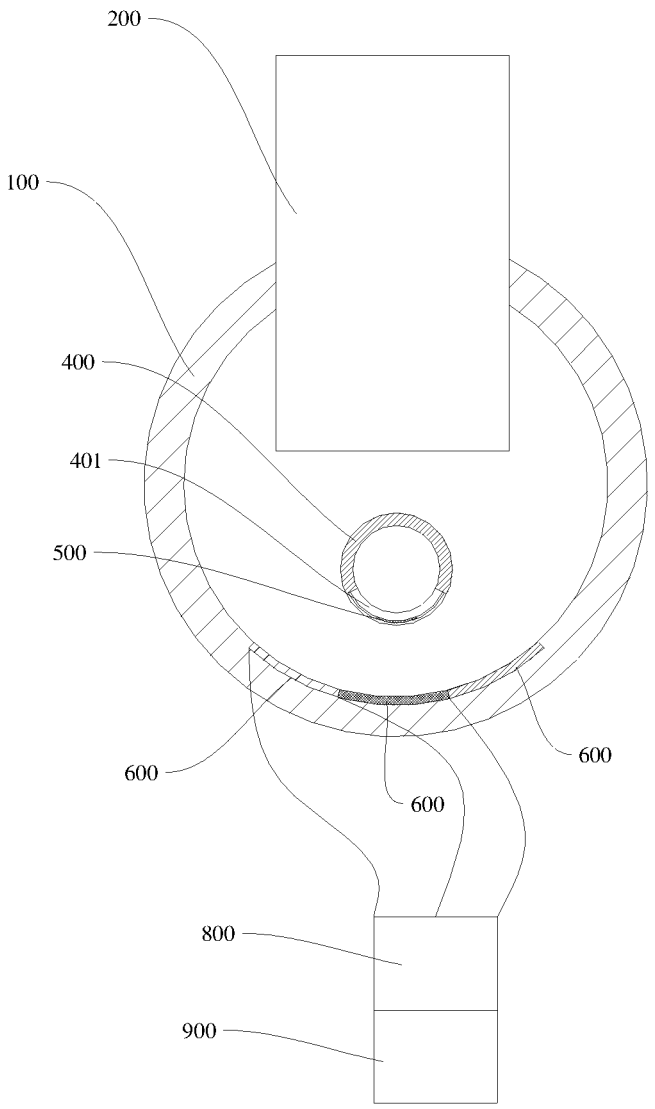
FIG. 11 is a schematic view of a header assembly according to yet still further embodiment of the present disclosure.

As shown in FIG. 11, in some embodiments, the driving member 600 may be disposed within the header 100, for example, on an inner wall of the header 100. The regulating member 500 may be a permanent magnet or a member capable of interacting with the permanent magnet via magnetic force, for instance, the regulating member 500 may be a steel part. In some embodiments, the driving member 600 includes a plurality of electromagnets disposed along the circumferential direction or the axial direction of the header 100 and spaced apart from each other.

A plurality of driving members 600 each of which is in the form of electromagnet may be connected to a power source 900 and a controller 800 via wires. The controller 800 is configured to control the plurality of electromagnets to selectively connect with the power source 900. Then the electromagnets which are connected with the power source 900 may generate magnetic force. By means of changing the electromagnets which are connected with the power source 900, the position where the magnetic force is generated may be changed, thus driving the regulating member 500 to move and thereby to regulate the regulating the distribution opening 401.

Figure 10:
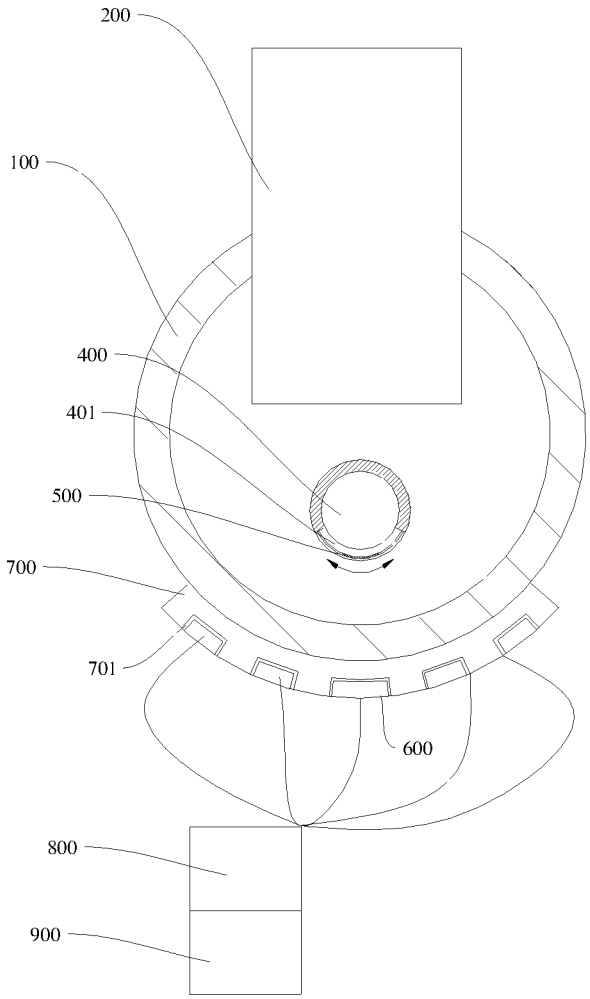
FIG. 10 is a schematic view of a header assembly according to a still further embodiment of the present disclosure.

In some embodiments, as shown in FIG. 10, the driving member 600 may be disposed externally of the header 100, for example, on the outer wall of the header 100. The regulating member 500 may be a permanent magnet or a member capable of interacting with the permanent magnet via magnetic force. The driving member 600 may include a plurality of electromagnets disposed along the circumferential direction or the axial direction of the header 100 and spaced apart from each other.

Similar to the embodiment shown in FIG. 11, a plurality of driving members 600 each of which is in the form of electromagnet may be connected to a power source 900 and a controller 800 via wires. The controller 800 is configured to control the plurality of electromagnets to selectively connect with the power source 900. Then the electromagnets which are connected with the power source 900 may generate magnetic force. By means of changing the electromagnets which are connected with the power source 900, the position where the magnetic force is generated may be changed, thus driving the regulating member 500 to move and thereby to regulate the distribution opening 401.

Similar to the embodiments shown in FIGS. 10 and 11, the distribution member may include a plurality of distribution openings 401 and the header assembly may include a plurality of regulating members 500 in one-to-one correspondence with the plurality of driving members 600. Alternatively, the distribution opening 401 is configured as an elongated groove extended along the axial direction of the distributing tube 400. The header assembly may include a plurality of regulating members 500 and a plurality of driving members 600 in one-to-one correspondence with the plurality of regulating members 500. The plurality of regulating members 500 may be spaced apart from each other in the axial direction of the distributing tube 400.

In some embodiments, it is appreciated that, the regulating member 500 may be movable along both the circumferential and axial directions of the distributing tube 400. Accordingly, the position of the driving member 600 along both the circumferential and axial directions of the distributing tube 400 may be adjustable.

Figure 12:
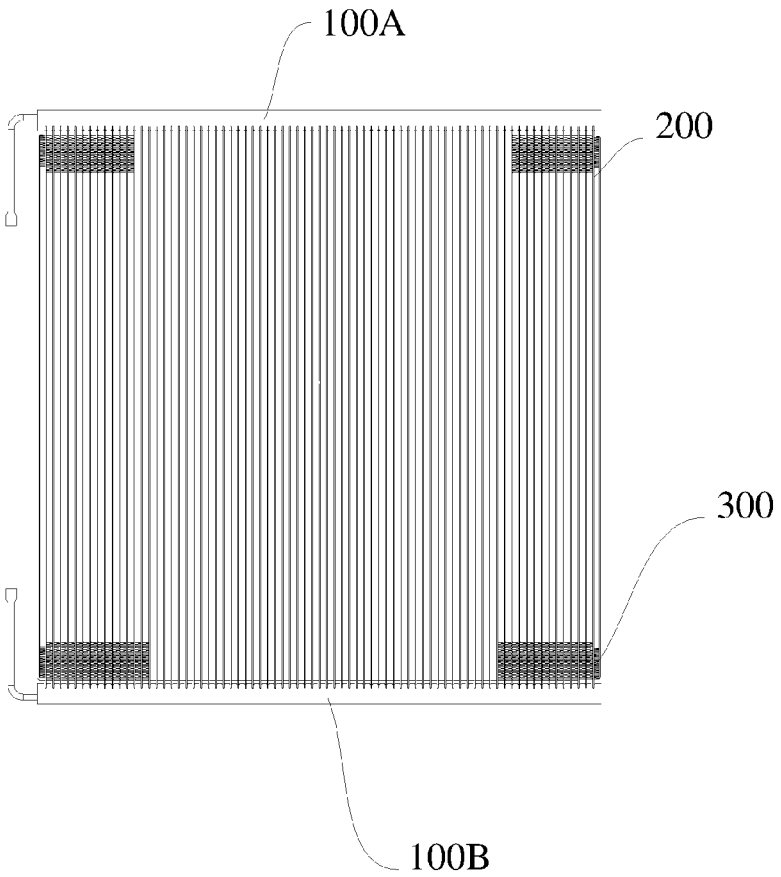
FIG. 12 is a schematic view of a heat exchanger according to an embodiment of the present disclosure.
Figure 13:
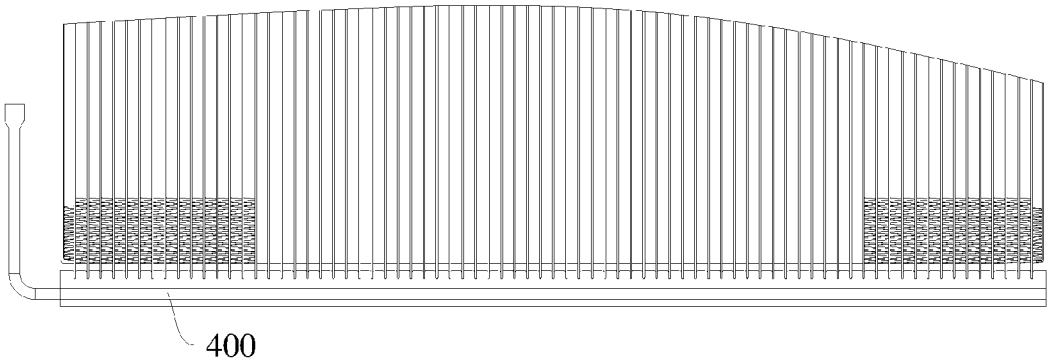
FIG. 13 is a partial enlarged view of a heat exchanger according to an embodiment of the present disclosure.

A heat exchanger according to embodiments of the present disclosure will be discussed with reference to FIGS. 12 and 13. As shown in FIGS. 12 and 13, the heat exchanger according to embodiments of the present disclosure may include a first header assembly, a second header assembly, tubes 200 and fins 300 disposed between adjacent tubes 200. As shown in FIGS. 12 and 13, only a part of fins 300 are shown for the sake of simplification.

At least one of the first and second header assemblies is the header assembly described with reference to the above to embodiments of the present disclosure. Two ends of the tube 200 are connected with the first and second header assemblies respectively, so that a first header 100A of the first header assembly is communicated with a second header 100B of the second header assembly. In other words, the tube 200 defines a first end connected with a first header 100A of the first header assembly, and a second end connected with a second header 100B of the second header assembly.

In some embodiments, the heat exchanger may be a micro-channel heat exchanger.

In some embodiments, the tube 200 may be a flat tube.

By means of changing the position of the driving member, the driving member may drive the regulating member via magnetic force, so that the regulating member moves to regulate the distribution opening. Then the heat exchanger according to embodiments of the present disclosure may be applied in different operation conditions and applications, which improves the applicability and distribution effect of the refrigerant. In addition, the heat exchanging effect may also be improved.

In the specification, it should be understood that, the terms such as "central", "longitudinal", "lateral", "width", "thickness", "above", "below", "front", "rear", "right", "left", "vertical", "horizontal", "top", "bottom", "inner", "outer", "clockwise", "counter-clockwise" should be construed to refer to the orientation as then described or as shown in the drawings. These terms are merely for convenience and concision of description and do not alone indicate or imply that the device or element referred to must have a particular orientation. Thus, it cannot be understood to limit the present disclosure.

In addition, terms such as "first" and "second" are used herein for purposes of description and are not intended to indicate or imply relative importance or significance or impliedly indicate quantity of the technical feature referred to. Thus, the feature defined with "first" and "second" may comprise one or more this feature. In the description of the present disclosure, "a plurality" of means including two or more than two this features, unless specified otherwise.

In the present invention, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communications of two elements, which can be understood by those skilled in the art according to specific situations.

In the present invention, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Furthermore, a first feature "on," "above," or "on top of" a second feature may include an embodiment in which the first feature is right or obliquely "on," "above," or "on top of" the second feature, or just means that the first feature is at a height higher than that of the second feature; while a first feature "below," "under," or "on bottom of" a second feature may include an embodiment in which the first feature is right or obliquely "below," "under," or "on bottom of" the second feature, or just means that the first feature is at a height lower than that of the second feature.

Reference throughout this specification to "an embodiment," "some embodiments," "one embodiment", "another example," "an example," "a specific example," or "some examples," means that a particular feature, structure, material, or characteristic described in connection with the embodiment or example is included in at least one embodiment or example of the present disclosure. Thus, the appearances of the phrases such as "in some embodiments," "in one embodiment", "in an embodiment", "in another example," "in an example," "in a specific example," or "in some examples," in various places throughout this specification are not necessarily referring to the same embodiment or example of the present disclosure. Furthermore, the particular features, structures, materials, or characteristics may be combined in any suitable manner in one or more embodiments or examples.

Although explanatory embodiments have been shown and described, it would be appreciated by those skilled in the art that the above embodiments cannot be construed to limit the present disclosure, and changes, alternatives, and modifications can be made in the embodiments without departing from spirit, principles and scope of the present disclosure.

The invention has been described in an illustrative manner. It is to be understood that the terminology which has been used is intended to be in the nature of words of description rather than of limitation. Many modifications and variations of the invention are possible in light of the above teachings. Therefore, within the scope of the appended claims, the invention may be practiced other than as specifically described.

What is claimed is:

1. A header assembly comprising:

a header;

a distribution member disposed within the header, and having at least one distribution opening, refrigerant flowing into the distribution member from outside of the header and being distributed into the header through the at least one distribution opening;

a regulating member disposed movably on the distribution member to regulate the distribution opening;

a driving member that drives the regulating member to move via magnetic force between the driving member and the regulating member, so as to regulate the distribution opening; and wherein the regulating member is movable along an axial direction of the header and a position of the driving member is adjustable along the axial direction of the header.

2. The header assembly according to claim 1, wherein the driving member is disposed on an outer wall of the header and a position of the driving member is adjustable.

3. The header assembly according to claim 2, wherein at least one of the regulating member and the driving member is a permanent magnet.

4. The header assembly according to claim 3, wherein one of the regulating member and the driving member is a permanent magnet; and the other of the regulating member and the driving member is capable of interacting with the permanent magnet via magnet force.

5. The header assembly according to claim 1, wherein a protrusion is disposed on an outer wall of the header, wherein at least one groove is formed in the protrusion to receive the driving member, wherein the position of the driving member is adjustable along the axial direction of the header.

6. The header assembly according to claim 5, wherein the at least one groove comprises one groove formed in the protrusion and extended along the axial direction of the header, wherein the driving member is slidably disposed in the one groove.

7. The header assembly according to claim 5, wherein the at least one groove comprises a plurality of grooves formed in the protrusion and spaced apart from each other along the axial direction of the header, wherein the driving member is selectively disposed in any of the plurality of grooves.

8. The header assembly according to claim 1, wherein a plurality of distribution openings, a plurality of regulating members and a plurality of driving members are provided, wherein the plurality of distribution openings are in one-to-one correspondence with the plurality of regulating members, and with the plurality of driving members, respectively, wherein the distribution member comprises a sliding groove formed at a position corresponding to the plurality of the distribution openings, wherein the plurality of regulating members are fitted in the sliding groove and movable along the axial direction of the header.

9. The header assembly according to claim 1, wherein the distribution opening is configured as an elongated groove extended along the axial direction of the header, wherein a plurality of regulating members are provided, a plurality of driving members are provided in one-to-one correspondence with the plurality of regulating members, and the plurality of regulating members are spaced apart from each other in the axial direction of the header.

10. A header assembly comprising:

a header;

a distribution member disposed within the header, and having at least one distribution opening, refrigerant flowing into the distribution member from outside of the header and being distributed into the header through the at least one distribution opening;

a regulating member disposed movably on the distribution member to regulate the distribution opening;

a driving member that drives the regulating member to move via magnetic force between the driving member and the regulating member, so as to regulate the distribution opening; and wherein the regulating member is movable along a circumferential direction of the header and a position of the driving member is adjustable along the circumferential direction of the header.

11. The header assembly according to claim 10, wherein the distribution member is configured as a distributing tube, and the distribution opening is configured as an elongated groove extended along a circumferential direction of the distributing tube, wherein the regulating member is disposed on a wall of the distributing tube and movable along the circumferential direction of the distributing tube, wherein the driving member is disposed on an outer wall of the header, wherein a protrusion is disposed on the outer wall of the header and at least one groove is formed in the protrusion, wherein the driving member is disposed in the at least one groove.

12. The header assembly according to claim 11, wherein the at least one groove comprises a plurality of grooves, and the driving member is adapted to be selectively disposed in any of the plurality of grooves.

13. The header assembly according to claim 11, wherein the at least one groove comprises one groove extended along the circumferential direction of the header, and the driving member is disposed in the one groove and slidable along the circumferential direction of the header.

14. The header assembly according to claim 11, wherein a plurality of distribution openings are provided and spaced apart in an axial direction of the distributing tube, wherein a plurality of protrusions are provided, spaced apart along an axial direction of the header in one-to-one correspondence with the plurality of distribution openings, wherein a plurality of driving members and a plurality of regulating members are provided, and the plurality of driving members are in one-to-one correspondence with the plurality of regulating members, with the plurality of distribution openings, and with the plurality of protrusions, respectively.

15. A header assembly comprising:

a header;

a distribution member disposed within the header, and having at least one distribution opening, refrigerant flowing into the distribution member from outside of the header and being distributed into the header through the at least one distribution opening;

a regulating member disposed movably on the distribution member to regulate the distribution opening;

a driving member that drives the regulating member to move via magnetic force between the driving member and the regulating member, so as to regulate the distribution opening;

wherein the distribution member is configured as a distributing tube, wherein the distribution opening is configured as an elongated groove extended along a spiral direction of the distributing tube, and the regulating member is disposed on a wall of the distributing tube and movable along the spiral direction, wherein the driving member is disposed on an outer wall of the header and a position of the driving member is adjustable along the spiral direction.

16. A header assembly comprising:

a header;

a distribution member disposed within the header, and having at least one distribution opening, refrigerant flowing into the distribution member from outside of the header and being distributed into the header through the at least one distribution opening;

a regulating member disposed movably on the distribution member to regulate the distribution opening;

a driving member that drives the regulating member to move via magnetic force between the driving member and the regulating member, so as to regulate the distribution opening;

wherein the regulating member is a permanent magnet or a member capable of interacting with a permanent magnet via magnetic force, wherein the driving member comprises a plurality of electromagnets disposed along a circumferential direction or an axial direction of the header and spaced apart from each other, wherein the driving member is disposed on an inner wall of the header.

17. The header assembly according to claim 16, wherein a plurality of driving members are provided, and a plurality of regulating members are provided in one-to-one correspondence with the plurality of driving members.

18. The header assembly according to claim 16, wherein the distribution opening is configured as an elongated groove extended along an axial direction of the distribution member, wherein a plurality of regulating members are provided, and a plurality of driving members are provided in one-to-one correspondence with the plurality of regulating members, wherein the plurality of regulating members are spaced apart from each other in the axial direction of the distribution member.

19. A header assembly comprising:

a header;

a distribution member disposed within the header, and having at least one distribution opening, refrigerant flowing into the distribution member from outside of the header and being distributed into the header through the at least one distribution opening;

a regulating member disposed movably on the distribution member to regulate the distribution opening;

a driving member that drives the regulating member to move via magnetic force between the driving member and the regulating member, so as to regulate the distribution opening;

wherein the regulating member is a permanent magnet or a member capable of interacting with a permanent magnet via magnetic force, wherein the driving member comprises a plurality of electromagnets disposed along a circumferential direction or an axial direction of the header and spaced apart from each other, wherein the driving member is disposed on an outer wall of the header.

20. A heat exchanger comprising:

first and second header assemblies, the first header assembly comprising a first header and the second header assembly comprising a second header;

a distribution member disposed within at least one of the first and second headers and having at least one distribution opening, refrigerant flowing into the distribution member from outside of the header and being distributed into the header through the at least one distribution opening;

a regulating member disposed movably on the distribution member to regulate the distribution opening;

a driving member that drives the regulating member to move via magnetic force between the driving member and the regulating member, so as to regulate the distribution opening;

tubes each defining a first end connected with the first header of the first header assembly, and a second end connected with the second header of the second header assembly; and fins disposed between adjacent tubes, wherein the regulating member is movable along an axial direction of the header and a position of the driving member is adjustable along the axial direction of the header; or wherein the regulating member is movable along a circumferential direction of the header and a position of the driving member is adjustable along the circumferential direction of the header.

* * * * *